US009254642B2

(12) United States Patent
Ciardella et al.

(10) Patent No.: US 9,254,642 B2
(45) Date of Patent: Feb. 9, 2016

(54) CONTROL METHOD AND APPARATUS FOR DISPENSING HIGH-QUALITY DROPS OF HIGH-VISCOSITY MATERIAL

(71) Applicants: Robert L. Ciardella, Rancho Santa Fe, CA (US); Duong La, Rancho Santa Fe, CA (US); Wai Ching Bessie Chin, Rancho Santa Fe, CA (US)

(72) Inventors: Robert L. Ciardella, Rancho Santa Fe, CA (US); Duong La, Rancho Santa Fe, CA (US); Wai Ching Bessie Chin, Rancho Santa Fe, CA (US)

(73) Assignee: Advanjet, Rancho Santa Fe, CA (US)

( * ) Notice: Subject to any disclaimer, the term of this patent is extended or adjusted under 35 U.S.C. 154(b) by 245 days.

(21) Appl. No.: 13/732,221

(22) Filed: Dec. 31, 2012

(65) Prior Publication Data

US 2014/0124600 A1 May 8, 2014

Related U.S. Application Data

(60) Provisional application No. 61/588,488, filed on Jan. 19, 2012.

(51) Int. Cl.

| | |
|---|---|
| ***B05B 1/30*** | (2006.01) |
| ***A62C 11/00*** | (2006.01) |
| ***B41J 2/045*** | (2006.01) |
| *B05C 11/10* | (2006.01) |

(52) U.S. Cl.

CPC ..... *B41J 2/045* (2013.01); *B05C 11/1034* (2013.01)

(58) Field of Classification Search

CPC ..... B41J 2/045; B05C 11/1034; B65D 83/48
USPC ..... 239/569, 329, 330, 583; 417/413.1, 53, 417/478, 479, 441, 203, 205, 417; 251/331; 347/68–70

See application file for complete search history.

(56) References Cited

U.S. PATENT DOCUMENTS

| | | | | |
|---|---|---|---|---|
| 4,095,722 | A | 6/1978 | Miller | |
| 4,383,264 | A * | 5/1983 | Lewis | B41J 2/14201 347/47 |
| 5,074,443 | A | 12/1991 | Fujii et al. | |
| 5,199,607 | A | 4/1993 | Shimano | |
| 5,205,439 | A | 4/1993 | Strum | |
| 5,320,250 | A | 6/1994 | La et al. | |

(Continued)

FOREIGN PATENT DOCUMENTS

| | | |
|---|---|---|
| EP | 2143503 A1 | 1/2010 |
| JP | 5168995 A | 7/1993 |

OTHER PUBLICATIONS

LIQUIDYN, Dispensing System Data sheet, Micro-dispensing valve P-jet.

(Continued)

*Primary Examiner* — Steven M Cernoch
(74) *Attorney, Agent, or Firm* — Stetina Brunda Garred & Brucker; Lowell Anderson

(57) ABSTRACT

This invention concerns a method and apparatus for dispensing minute quantities of fluids and more particularly rapidly dispensing highly precise and repeatable, minute amounts of viscous fluids in a non-contact manner. An impacting element is impacted against a hardened insert on a flexible diaphragm to deflect the insert into a jetting chamber and against an outlet orifice in the jetting chamber. The movement of the diaphragm and insert force viscous fluid in the chamber through the outlet orifice and the impact jets that fluid from the outlet orifice, with the impact force being adjusted to jet the fluid from the orifice in a single drop.

16 Claims, 11 Drawing Sheets

(56) References Cited

U.S. PATENT DOCUMENTS 5,405,050 A 4/1995 Walsh
5,431,343 A 7/1995 Kubiak et al.
5,462,199 A 10/1995 Lenhardt
5,505,777 A 4/1996 Ciardella et al.
5,593,290 A * 1/1997 Greisch ..... F04B 19/006 417/478
5,711,989 A 1/1998 Ciardella et al.
5,743,960 A 4/1998 Tisone
5,747,102 A 5/1998 Smith et al.
5,913,455 A 6/1999 La et al.
6,032,832 A * 3/2000 Dority ..... B05C 5/0225 222/214
6,082,605 A 7/2000 Farnworth
6,173,864 B1 1/2001 Reighard et al.
6,253,957 B1 7/2001 Messerly et al.
6,267,266 B1 7/2001 Smith et al.
6,270,019 B1 8/2001 Reighard
6,291,016 B1 9/2001 Donges et al.
6,325,271 B1 12/2001 Farnworth
6,329,013 B1 12/2001 Putt
6,350,494 B1 2/2002 Farnworth
6,354,471 B2 3/2002 Fujii
6,415,995 B1 7/2002 Enderle et al.
6,416,294 B1 7/2002 Zengerle et al.
6,450,416 B1 9/2002 Berg et al.
6,537,505 B1 3/2003 LaBudde et al.
6,562,406 B1 * 5/2003 Chikahisa ..... B05C 11/1034 118/410
6,758,837 B2 * 7/2004 Peclat ..... A61F 9/0008 222/325
6,915,928 B2 7/2005 Brooks
7,104,768 B2 9/2006 Richter et al.
7,131,555 B2 11/2006 Maruyama et al.
7,296,707 B2 11/2007 Raines et al.
7,490,735 B2 2/2009 Raines et al.
7,694,855 B2 * 4/2010 Chastine ..... B05C 5/001 137/625.44
7,694,857 B1 4/2010 Fugere
7,713,034 B2 * 5/2010 Ogawa ..... F04B 43/025 417/413.1
7,767,266 B2 8/2010 Holm et al.
7,900,800 B2 3/2011 Hassler, Jr. et al.
7,939,125 B2 5/2011 Abernathy et al.
8,056,827 B2 11/2011 Xu
8,074,467 B2 12/2011 Fiske et al.
8,136,705 B2 3/2012 Tracy et al.
8,181,468 B2 5/2012 Fiske et al.
8,201,716 B2 * 6/2012 Chastine ..... B05C 5/001 137/875
8,215,535 B2 7/2012 Jolm et al.
8,257,779 B2 9/2012 Abernathy et al.
8,262,179 B2 9/2012 Ikushima
8,322,575 B2 * 12/2012 Riney ..... B05C 5/001 222/146.5
8,757,511 B2 * 6/2014 Ciardella ..... B41J 2/04 239/93
2002/0017238 A1 * 2/2002 Shinozaki ..... B05C 5/0258 118/668
2002/0112821 A1 * 8/2002 Inaba ..... B05C 5/001 156/359
2003/0003027 A1 1/2003 Albert et al.
2003/0132243 A1 7/2003 Engel
2003/0185096 A1 10/2003 Hollstein et al.
2005/0072815 A1 4/2005 Carew et al.
2005/0236438 A1 * 10/2005 Chastine ..... B05C 5/001 222/504
2006/0077237 A1 4/2006 Shin et al.
2006/0081807 A1 * 4/2006 Browne ..... F16K 7/12 251/331
2006/0147313 A1 7/2006 Zengerle et al.
2006/0157517 A1 7/2006 Fiske et al.
2007/0069041 A1 3/2007 Quinones et al.
2007/0145164 A1 6/2007 Ahmadi et al.
2008/0006653 A1 1/2008 Dai et al.
2008/0105703 A1 5/2008 Prentice et al.
2008/0149691 A1 6/2008 Fujii
2008/0312025 A1 12/2008 Spickard
2009/0078720 A1 3/2009 Abernathy et al.
2009/0095825 A1 4/2009 Ahmadi et al.
2009/0115825 A1 5/2009 Peng et al.
2009/0167818 A1 7/2009 Morita
2010/0181337 A1 7/2010 Ikushima
2010/0252576 A1 10/2010 Fiske et al.
2010/0294810 A1 11/2010 Ikushima
2012/0286072 A1 11/2012 Saidman et al.
2013/0048759 A1 * 2/2013 Aguilar ..... B05C 5/0291 239/562
2013/0052359 A1 2/2013 Ahmadi et al.

OTHER PUBLICATIONS

PVA, Data Sheet, Non-contact micro dispensing valve, valve specifications.
AEROJET, Data Sheet, Non-contact jet dispenser for high viscous materials.
EFD, Data Sheet, PicoDot Jet dispensing system.
ASYMTEK, Data Sheet, High-speed Piezo jet dispensing for liquid crystal fluids.

* cited by examiner

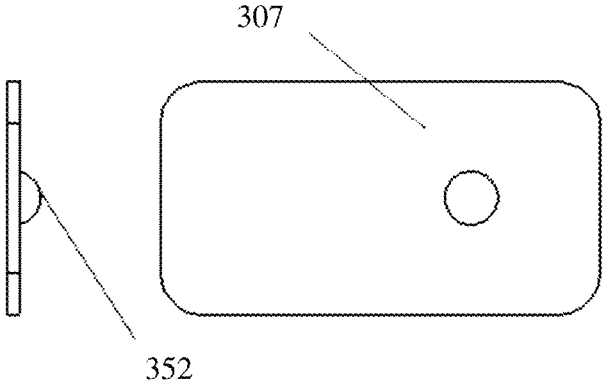
FIG. 2a FIG. 2b
FIG. 2c
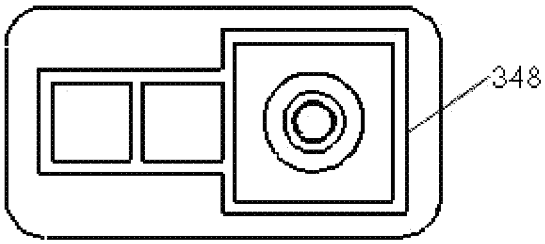
FIG. 2d
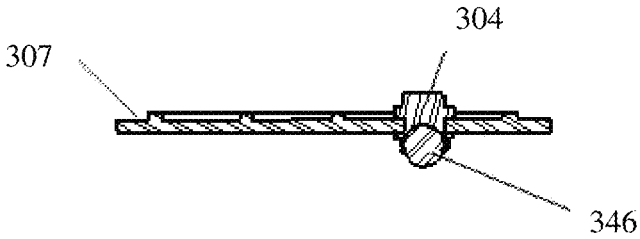
FIG. 2e
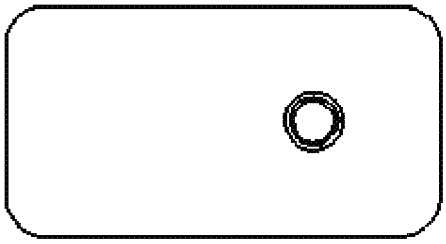

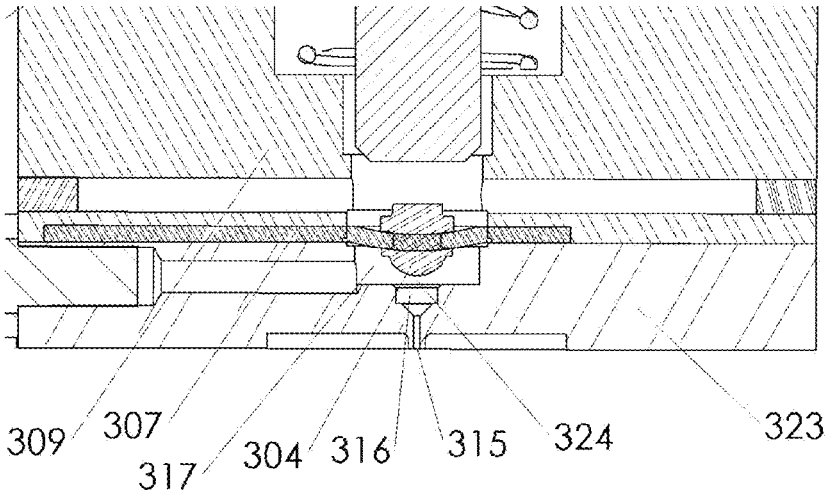
*FIG. 6*
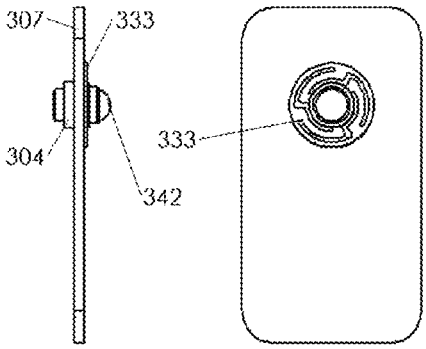
*FIG. 7a* *FIG. 7b*
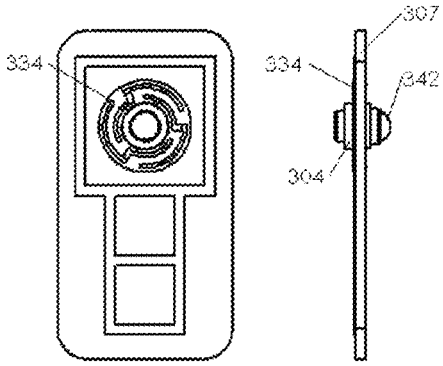
*FIG. 7c* *FIG. 7d*

CONTROL METHOD AND APPARATUS FOR DISPENSING HIGH-QUALITY DROPS OF HIGH-VISCOSITY MATERIAL

CROSS-REFERENCE TO RELATED APPLICATIONS

The application claims the benefit under 35 U.S.C. §119(e) to Provisional Patent Application Ser. No. 61/588,488 filed Jan. 19, 2012, titled CONTROL METHOD AND APPARATUS FOR DISPENSING HIGH-QUALITY DROPS OF HIGH-VISCOSITY MATERIAL, the entire contents of which are incorporated herein by reference.

BACKGROUND

In the semiconductor, electronics and life science industries viscous fluids are frequently dispensed. The demands to miniaturize in these industries require smaller and faster deposition of viscous fluids. Non-contact dispensing, often referred to as jet dispensing, is preferred for many reasons, some of which might be the ability to dispense drops while moving above a surface, the speed of drop formation, and the minute size and precision of the drops produced. Jetting as used herein refers to non-contact dispensing as compared to contact dispensing. Contact dispensing is the process where a fluid drop on the end of a dispensing tip comes into contact with the target substrate while still in contact with the dispensing tip so that the fluid drop "wets" or clings to the substrate and remains on the surface of the substrate as the dispensing tip pulls away. In the case of ink jet technology, inks with a viscosity very near water (<10 millipascal-seconds or mPas) are jetted. In the case of viscous jet technologies, fluids with high viscosities (>50 mPas) can be jetted. Examples of viscous fluids include adhesives, fluxes, oils, lubricants, conformal coatings, paints, slurries, UV inks, proteins, and enzymes.

As known in the industry, to produce a free flying jetted drop, energy must be imparted to the fluid which transfers enough momentum to force fluid through an orifice with the appropriate exit velocity for the fluid to break into a free flying drop. However, due to the different rheology of each fluid, the momentum transfer required and the resulting exit velocity to produce high-quality drops can be different. A high-quality drop of fluid as defined here is a drop that breaks-off cleanly (without satellite droplets separated from the main drop and without leaving behind residue that affects the succeeding drop volume or directionality) from the exit orifice and travels to the surface resulting in a single deposit of fluid on the surface. Given a specific amount of momentum transfer, one fluid can generate high-quality drops but a different fluid can generate poor quality drops, drops that accumulate on the nozzle tip or even fail to generate a drop. Poor quality drops could be caused by small "satellite" droplets that separate from the main drop and form multiple deposits on the surface. Or, poor quality drops could be a result of excessively high exit velocity of the drop which can hit the surface and form splattered droplets surrounding the main drop. In both cases, the resulting jetted drop would not be considered high-quality, nor would the failure to generate an expected drop be considered high-quality. Other measures of high-quality drops could be the repeatability of the drop size, shape of the drop, or other measures. There is thus a need for a method and apparatus to precisely measure, adjust, and control the transfer of momentum to the fluid, and/or the resulting drop exit velocity that would be beneficial for producing repeatable, high-quality jetted drops of viscous fluid. Advantageously, the fluid has a viscosity of greater than about 50 mPas, and more preferably a viscosity of over 150 mPas.

Non-contact jets generally have specific construction which either restricts the flow of material through the exit orifice in the power-off state, a normally-closed construction, or allows the flow of material through the orifice in the power-off state, a normally open construction. Jetting high-viscosity fluid using a flexible diaphragm is known and described in U.S. patent application 61/293,837 and U.S. Pat. No. 5,320,250. A flexible diaphragm is preferred for many reasons, some of which might be the lack of dynamic fluid seals and ease of cleaning. However, the normally-open construction can allow the fluid to drip from the orifice when the power to the jet is shut off which can cause a loss of fluid and require the time and expense of clean up. There is thus a need for a method and apparatus to close the fluid path automatically when the power is shut off.

When jetting fluid with a flexible diaphragm, the diaphragm material should be chemically compatible with the fluid being jetted. Some chemically aggressive fluids can have an adverse effect on an elastomeric diaphragm usually noted by swelling of the diaphragm material. If swelling occurs, the diaphragm can deflect into the jetting chamber and restrict the flow of fluid into the jetting chamber or to reduce the chamber volume. If flow is restricted or the chamber volume reduced, the quality of the jetted drop can be adversely affected. There is thus a need for a way to determine if the diaphragm material has swollen and has deflected into the jetting chamber. Additionally, the overall life of the diaphragm can be compromised by swelling. There are chemically inert materials that can be used as a diaphragm; however, the cost of these chemically inert materials can be very expensive. There is thus a need for a way to use a low-cost diaphragm material with aggressive fluids and to also minimize the effect of swelling.

BRIEF SUMMARY

It is the objective of this invention to provide a non-contact jetting method and apparatus to jet high-quality drops of viscous fluid.

It is a further objective of this invention to determine the amount of momentum transferred to the fluid during the jetting process and use this information to produce high-quality drops.

It is a further objective of this invention to provide a method to adjust the momentum transfer to produce high-quality drops of viscous fluid.

It is a further objective of this invention to provide a method to measure and adjust the drop exit velocity to produce high-quality drops of viscous fluid.

It is a further objective of this invention to measure if the diaphragm has deflected into the jetting chamber and restricts the flow of fluid into the jetting chamber or reduces the usable volume of the jetting chamber.

It is further an objective of this invention to provide a method to determine if the diaphragm has been adversely affected by aggressive fluids.

It is a further objective of this invention to provide a means to increase the life of a flexible diaphragm when using chemically aggressive fluids.

It is a further objective of this invention to provide a positive shut-off mechanism for a normally-open flexible diaphragm jetting apparatus which will impede the flow of fluid through the orifice when the power is off.

One or more of these objectives and other advantages may be achieved by providing a viscous jetting apparatus for jetting high-quality minute quantities of viscous fluid as described further in this disclosure.

The jetting apparatus may include a pressurized fluid source, a jetting chamber, a compliant diaphragm containing a contoured insert, an inlet channel, an outlet path, an orifice, a supporting structure, a pressure source, an adjustable impact element, a pair of sensing elements, and a positive shutoff actuator. The jetting chamber has as its top wall a suitably flexible, compliant diaphragm. The diaphragm is contained between the jetting chamber and the supporting structure and is easily removed for cleaning or replacement. The jetting chamber communicates with a dispensing orifice by means of an outlet conduit. The jetting chamber is connected to a fluid inlet channel which communicates with a pressurized viscous fluid source. With the impact element retracted, fluid flows from the fluid source unimpeded through the inlet channel and into the jetting chamber. The diaphragm is then forced to rapidly deform away from the supporting structure by an impact element. The diaphragm deforms into the jetting chamber and displaces an amount of fluid contained within the jetting chamber until a central protrusion of the diaphragm insert mates with the top of the outlet chamber and ejects a drop of fluid that breaks away from the dispensing orifice and flies to a substrate. The impact element is retracted and the diaphragm is urged away from the outlet chamber aided by the fluid pressure and by the restorative force of the deformed diaphragm. The diaphragm returns to its initial starting position which optionally is flat, but can be biased into or away from the jetting chamber. Fluid from the source enters the jetting chamber and flows past the central protrusion of the diaphragm insert and enters the outlet conduit to refill the volume of fluid which has been ejected. The volume of fluid that enters the jetting chamber is a function of the fluid flow rate and the time the impact element is retracted. Once the appropriate volume has refilled the jetting chamber, the impact element will cycle and eject another drop of fluid.

The quality of the ejected drop is dependent upon several factors, three of which are the rheology of the fluid, the drop exit velocity, and the level of momentum transferred to the fluid. A method of calibration is advantageously provided that may include setting an impact gap, measuring and/or changing the distance the impact element travels before it impacts the diaphragm, ejecting a drop or series of drops, measuring the drop velocity, inspecting the quality of the ejected drop or drops, and selecting a preferred impact gap to ensure high-quality, reliable jetting. The method of calibration can be repeated and used to determine fluid specific preferred impact gaps and the resulting preferred drop velocities and momentum transfer parameters for a multitude of different fluids. These fluid specific parameters can be stored in electronic, optical or other accessible memory associated with the equipment and used each time a specific fluid is jetted, drastically reducing the required set-up time for each fluid. Optionally, but preferred, a pair of sensing elements can be used to determine the initial impact gap automatically. Once the impact element starts to move, the sensing elements measure the change in position of a location on the impact element. Using this information the velocity of the impact element can be determined. Using this velocity and knowing the mass of the impact element, the amount of momentum transfer can be calculated. This resulting value of momentum transfer which produces the highest quality drops can be used to adjust the position of the impact element for reliable high-quality jetting. The method could include the additional step of measuring the velocity of the impact element during operation, comparing the actual velocity to the preferred velocity, and making adjustments to the speed of the impact element or the distance of the impact gap so reliable high-quality jetting is maintained. The method may also include adjusting the gap and/or velocity until the desired quality of drops is achieved. The method may also include setting an alarm to notify the user that the current values of momentum transfer or impact gap are not at the preferred values.

Alternatively, a calibration method using at least one and preferably a pair of sensing elements (or an emitter and detector) to determine the drop exit velocity can be used to determine the preferred parameters for high-quality jetting. Sensing elements can be located below the nozzle orifice and in line with the drop path to detect when a drop passes by the sensing element. Along with signals from the jet control electronics, the time interval between when a drop was commanded to eject and the time a drop is detected by the sensing elements can be determined. Using this time interval information along with distance between the orifice and the sensors, the velocity of the drop can be determined. By varying the impact momentum transfer to the fluid resulting in different exit velocities, a preferred drop velocity for high-quality drops can be determined. Using the preferred value of the drop exit velocity which produces the highest quality drops, the preferred position or speed of the impact element for reliable high-quality jetting can be determined. The method could include the additional step of measuring the drop velocity during operation, comparing the measured velocity to the preferred velocity, and making adjustments to the speed of the impact element or the distance of the impact gap to alter the drop velocity so reliable high-quality jetting is maintained. The method may also include adjusting the gap velocity until the desired quality of drops is achieved. The method may also include setting an alarm to notify the user that the current value of drop velocity is not at the preferred value.

There is also advantageously provided a power-off, positive shut-off means. To ensure fluid does not leak out the orifice when power is shut off, a positive shutoff actuator is automatically engaged when power to the jetting apparatus is turned off. The actuator deflects the impact element which forces the diaphragm to mate with the top of the outlet conduit impeding the flow of fluid out the orifice and also preferably shutting off flow into the jetting chamber.

There is also advantageously provided a jetting apparatus for jetting chemically aggressive high-viscosity fluids that may include a jetting chamber, a compliant diaphragm containing a contoured insert, a diaphragm spring, a pressure source, an inlet channel, an outlet path, an orifice, a supporting structure, an adjustable impact element, sensing elements, and a diaphragm spring. The diaphragm with a diaphragm spring affecting the contoured diaphragm insert is contained between the jetting chamber and the supporting structure and is easily removed for cleaning or replacement. The jetting chamber is in fluid communication with a dispensing orifice by means of an outlet conduit. The jetting chamber is connected to a fluid inlet channel which is in fluid communication with a pressurized viscous fluid source. Fluid flows from the fluid source through the inlet channel and into the jetting chamber. The diaphragm is forced to rapidly deform away from the supporting structure and toward the outlet orifice by an impact element. The diaphragm and central protrusion deform into the jetting chamber displaces an amount of fluid contained within the jetting chamber until the central protrusion mates with the top of the outlet chamber and ejects a drop of fluid that breaks away from the dispensing orifice and flies to a substrate. The impact element is retracted and the diaphragm starts to relax and return to its initial flat position.

However, if a chemically aggressive fluid is used, the diaphragm material can react with the fluid and cause local swelling in the area of the jetting chamber. If swelling occurs, the diaphragm would no longer be able to return to its relaxed flat position and the swelling may cause the diaphragm or central protrusion to occupy a portion of the chamber volume within the cavity formed by the chamber sidewalls. The flow gap, the distance between the tip of the central protrusion of the diaphragm insert and the top of the outlet conduit, will be decreased by swelling. If the flow gap is decreased due to the local swelling of the diaphragm, the quality of the jetted drops can be adversely affected. However, the addition of a diaphragm spring or springs can force the diaphragm back to its initial flat position thus mitigating the adverse effect of the local swelling and maintaining the desired flow gap.

Additionally, the sensing elements as described above to measure the impact gap can also be used to determine if the flow gap has changed. The method of determining if the flow gap has changed advantageously includes setting a preferred impact gap as described above, measuring the distance of the impact gap during operation, comparing the actual gap to the preferred gap, and alerting the user to inspect or replace the diaphragm or adjust the equipment to achieve desired drop quality.

BRIEF DESCRIPTION OF THE DRAWINGS

The structure, operation, and advantages of the presently preferred embodiments disclosed herein will be better understood upon consideration of the following description taken in conjunction with the accompanying drawings, in which like numbers refer to like parts throughout, and in which:

FIG. 2*a* is a side view showing a diaphragm with an integral contoured central protrusion;

FIG. 2*b* is a bottom view of the diaphragm of FIG. 2*a;*

FIG. 2*c* is a top view showing a flexible diaphragm with a dual-material contoured diaphragm insert so the insert protrudes through the diaphragm and sealing features;

FIG. 2*d* is a sectioned side view of the diaphragm of FIG. 2*c*, through the middle of FIG. 2*c;*

FIG. 2*e* is a bottom view of the flexible diaphragm of FIG. 2*c;*

FIG. 6 is an enlarged side view, in cross section of a jetting apparatus with a swollen, fully relaxed compliant diaphragm with a contoured diaphragm insert, an inlet conduit recessed in the nozzle plate, and an impact element in a retracted position;

FIG. 7*a* is a side view showing a diaphragm with a two-piece contoured metal diaphragm insert having a diaphragm spring attached to the side of the diaphragm that is in contact with the jetted fluid during use;

FIG. 7*b* is a bottom view of the diaphragm of FIG. 7*a;*

FIG. 7*c* is a top view showing a diaphragm with a two-piece contoured metal diaphragm insert with a diaphragm spring attached to the side of diaphragm that is not in contact with the jetted fluid during use;

FIG. 7*d* is a side view of the diaphragm of FIG. 7*c;*

DETAILED DESCRIPTION

Figure 1A:
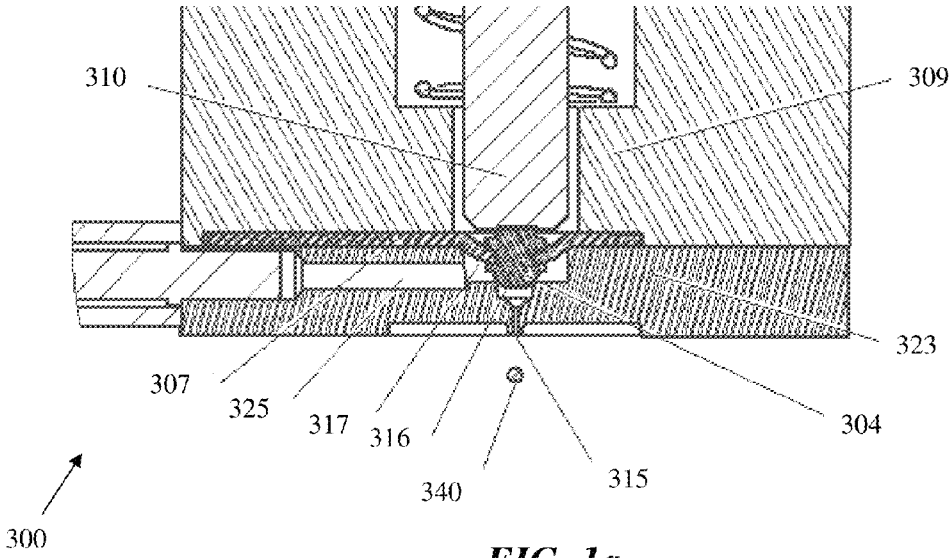
FIG. 1*a* is a side view in cross section of an the jetting chamber assembly utilizing a flexible diaphragm with a contoured diaphragm insert attached so it protrudes through the diaphragm being deformed by an impact element and is in a condition just after a drop of viscous fluid has been jetted.
Figure 1B:
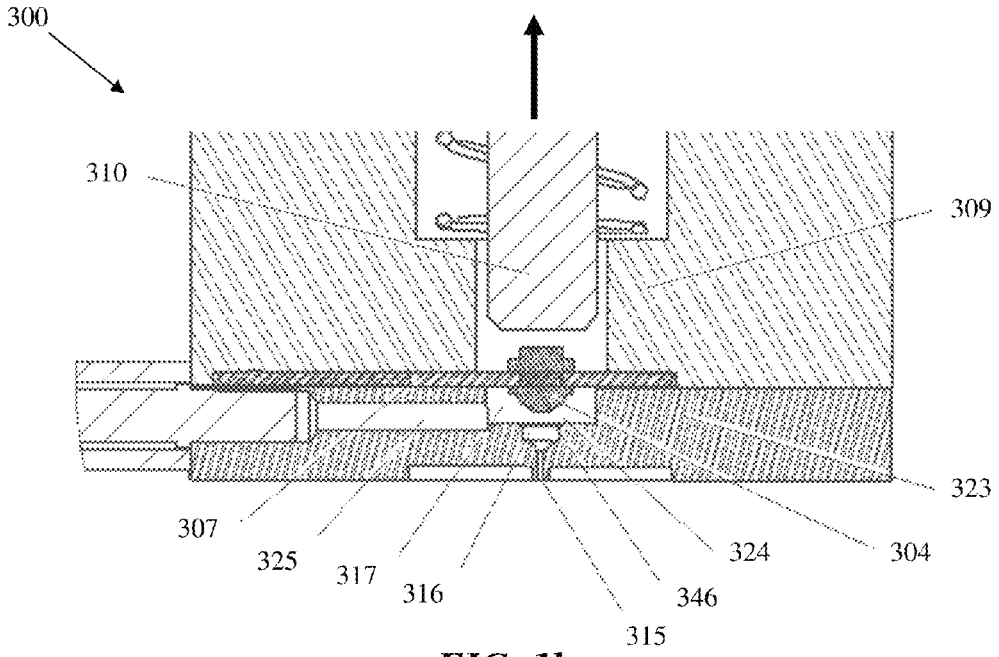
FIG. 1*b* is a side view in cross section of an the jetting chamber assembly utilizing a flexible diaphragm with a contoured diaphragm insert attached so it protrudes through the diaphragm in a relaxed condition with an impact element retracted.

Referring to FIGS. 1*a* and 1*b*, there is illustrated a jetting chamber assembly 300 capable of jetting a minute drop of viscous fluid. Shown in FIG. 1*a*, the jetting chamber assembly 300 is in a condition similar to a condition just after a drop of viscous fluid has been jetted. A compliant diaphragm 307 with a molded-in central insert is located between a supporting structure 309 and a nozzle plate 323 and centered above jetting chamber 317. The diaphragm 307 is compressed between support structure 309 and nozzle plate 323 to form a fluid tight seal between the supporting structure 309 and nozzle plate 323 while allowing the portion of the diaphragm 307 located above the jetting chamber 317 to deform into the jetting chamber 317. An impact element 310 has impacted diaphragm 307 and deflected it downward until diaphragm insert 304 rests against the top of the outlet chamber 316 and ejected a drop 340 of viscous fluid.

The impact element 310 transfers momentum to the fluid forcing a viscous fluid drop 340 to break-off from the orifice 315. High momentum transfer is desirable especially when jetting viscous fluid. The deflection speed of the diaphragm 307 determines the magnitude of the exit velocity and the quality of the jetted drop and is dependent on the driving force applied. As will be shown later, the position and or the speed of the impact element 310 can be adjusted to produce high-quality jetted drops.

The jetting chamber 317 geometry could be any continuous contour and has an outlet conduit 316 centered at the bottom the chamber 317. As shown in FIG. 1*b*, located at the transition between the bottom of chamber 317 and outlet conduit 316 is radius 346. Radius 346 provides a good sealing surface for the diaphragm insert 304 and when engaged impedes the flow of fluid out the orifice. Preferably, the shape of radius 346 is spherical, but a chamfer is believed suitable. Other shapes are believed suitable.

Likewise, the diaphragm 307 is preferably, but optionally, constructed and held by supporting structure 309 so that the diaphragm insert 304 consistently travels along a common longitudinally axis with outlet conduit 316. The diaphragm 307 is preferably made of an elastomeric material which returns to its undeformed, preferably planar shape when no distorting or deforming load acts upon the diaphragm. The diaphragm 307 is made of a thin, resilient material, typically a few millimeters thick, and preferably even thinner. As seen in FIGS. 2*c* and 2*d*, at least one side of the diaphragm 307 may have raised surfaces or ribs to form defined seals when they abut mating surfaces, or to fit into and seal with mating recesses having corresponding shapes as the raised surfaces or ribs. The depicted raised surfaces are straight sided, but curved or circular raised surfaces or ribs may be used.

Figure 5A:
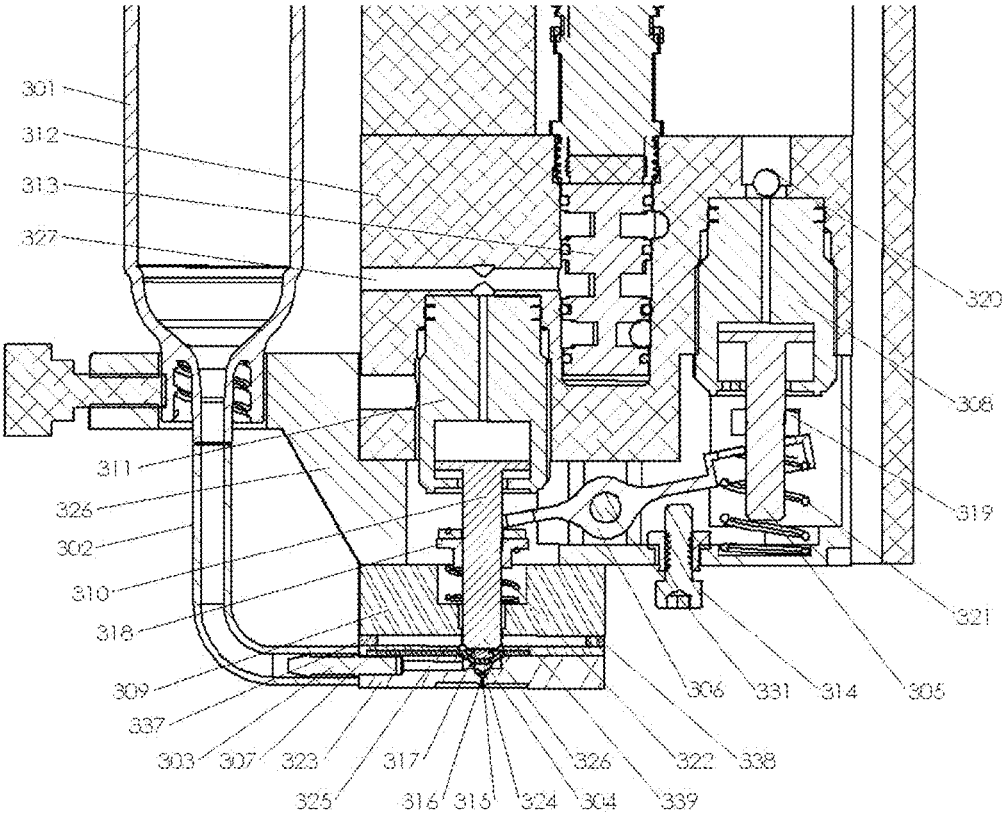
FIG. 5*a* is a side view in cross section of a viscous jetting apparatus in a power-off condition showing the impact element being deflected by the shut-off actuator spring and deflecting the diaphragm so it mates with the top of the outlet conduit and impedes the flow of fluid out the orifice.

A dispensing orifice 315 protrudes from the nozzle plate 323 having an outlet conduit 316 in fluid communication with jetting chamber 317. A fluid inlet channel 325 located within nozzle plate 323 communicates with the jetting chamber 317. Fluid flows into the jetting chamber 317 through the inlet channel 325 from a fluid reservoir 301 (FIG. 5*a*). The fluid inlet 325 advantageously opens into a side of the jetting chamber 317, with the inlet 325 preferably, but optionally, not being blocked during expulsion of a viscous drop from the jetting orifice 315. Advantageously, but optionally, there is an open path from the jetting chamber 317 to the fluid reservoir. This makes for a simpler design.

As shown in FIG. 1*b*, with the impact element fully retracted, the diaphragm 307 is allowed to move to an undeflected, fully relaxed position aided by the fluid pressure in the jetting chamber. The fluid inlet channel 325 allows fluid to flow into the jetting chamber 317. Filling the jetting chamber 317 is often referred to as the refill cycle and is a very crucial part of the jetting process. In one case, a pressurized fluid reservoir (not shown) can be used to feed fluid into the jetting chamber 317. In this case, the pressure level on the fluid reservoir (not shown) and the flow characteristics of the fluid and jetting chamber assembly 300 will determine a fluid flow rate. The actual amount of fluid that flows into the jetting chamber 317 may be proportional to the fluid flow rate and the length of time the fluid is allowed to flow. The fluid flow rate is affected by the fluid rheology, the dimensions along the flow path, including the diameter of the outlet conduit 316, the size of the flow gap 324 and the diameter of the orifice 315. The volume of fluid that flows into the outlet conduit 316 can be incrementally adjusted. For example, adjusting the pressure to the fluid reservoir, the temperature of the fluid, and/or the time the diaphragm is retracted will change the volume of fluid flow into the outlet conduit, thus producing multiple jetted drop volumes. In another case, a positive metering pump, such as a syringe pump, gear pump, auger pump, positive cavity pump, or peristaltic pump (none shown), can be used to feed fluid into the inlet channel 325. In this case, a precise, predetermined volume of fluid which does not vary with time is forced into the jetting chamber 317 by the positive metering pump.

The diaphragm 307 is preferably not flat as a contoured detail is advantageously provided at or adjacent to the middle of the jetting chamber during use. Shown in FIGS. 2*a* and 2*b*, is an illustration of a small semi-spherical portion 352 located on the diaphragm 307 and positioned on the diaphragm so as to locate over the jetting chamber 317. Advantageously, the semi-spherical portion 352 is integrally molded with the diaphragm 307 and extends beyond the remainder or generally planar surface of the diaphragm. The semi-spherical portion 352 intrudes into the jetting chamber 317 and reduces the volume of the jetting chamber 317. The semi-spherical portion 352 on diaphragm 307 is only an example of one contoured shape as other shapes, including domed, conical or frusto-conical shapes, or other shapes which may be integrally formed as part 352 on diaphragm 307.

Preferably, as shown in FIGS. 2*c*, 2*d*, and 2*e*, the diaphragm 307 may have an insert portion 304 comprised of a different material than the diaphragm 307 so the diaphragm 307 has an elastomeric outer portion and a much stiffer or rigid inner insert portion 304. For example, insert portion 304 could be metal or hard plastic, with a domed or semi-spherical portion protruding into jetting chamber 317. The insert 304 may have optional outwardly extending flanges that are integral to the insert as shown in FIG. 2*d* or the flanges might be clamped, adhered, thermally bonded, molded or otherwise fastened to opposing surfaces of diaphragm 307. The fastening method or mechanism will vary with the materials of diaphragm 307 and insert 304, and may include mechanical fastening mechanisms, adhesives, melting, integral forming of parts, and other fastening means now known or developed in the future. Preferably, the insert 304 is centered over the outlet orifice 315 and outlet conduit 316 and has a longitudinal axis aligned with the orifice 315 and conduit 316, with that longitudinal axis passing through the center of the jetting chamber 317 and insert 304. Optionally, an o-ring type sealing feature 348 which protrudes from the diaphragm surface may be beneficial in forming a fluid tight seal when the diaphragm is compressed between the supporting structure 309 and the nozzle plate 323.

The diaphragm 307 of one material, used with an insert 304 of a second material provides a dual material diaphragm. When such a dual material diaphragm 307, 304 is fully deflected, the harder insert portion 304 impacts the jetting chamber 317 without the damping effect of the elastomeric material forming the remainder of diaphragm 307. The momentum transfer efficiency from the harder insert portion 304 is therefore higher. If insert portion 304 included a shape facing opposite the orifice 315 which also extended through or into the support structure 309, then a mechanical element such as spring 334 shown in FIG. 7*c* could be readily attached to the insert 304 to provide one direction or bidirectional forced deflection of the diaphragm 307. The use of a harder insert 304 in diaphragm 307 is preferred when high impact efficiency is required. Or, the bidirectional forced deflection might be preferred when a sticky or viscous fluid might tend to restrict the relaxation speed of an elastomeric diaphragm 307 so as to cause an unacceptably slow jetting time of viscous drops. An insert 304 that is at least 5-10 times harder than the remainder of diaphragm 307 extending into or over the jetting chamber 317 is preferred.

The diaphragm insert 304 should be made of a suitably nonreactive metal since it is contact with the fluid and in the absence of the hardened tip 346 should be suitably hard so it does not wear prematurely due to impacting the top of the outlet conduit. Stainless steel is believed suitable. A hardened tip can be used to increase the life of the diaphragm. The hardened tip can be attached by welding, gluing, swaging or other suitable fastening methods. As shown in FIG. 2*d*, a hardened tungsten carbide ball 346 is fastened to insert 304. Advantageously the insert has a recess configured to receive the ball 346, such as a semi-spherical socket, with the ball 346 being retained therein. A socket formed in a stainless steel insert 304, with the insert swaged to retain the tungsten carbide ball 346, is believed suitable. Typical ball diameters range from 1-4 mm. Tungsten carbide is believed suitable for the hardened tip. Hardened tool steel with chrome or nickel plating is also believed suitable. Other hard materials are also believed suitable.

Figure 3A:
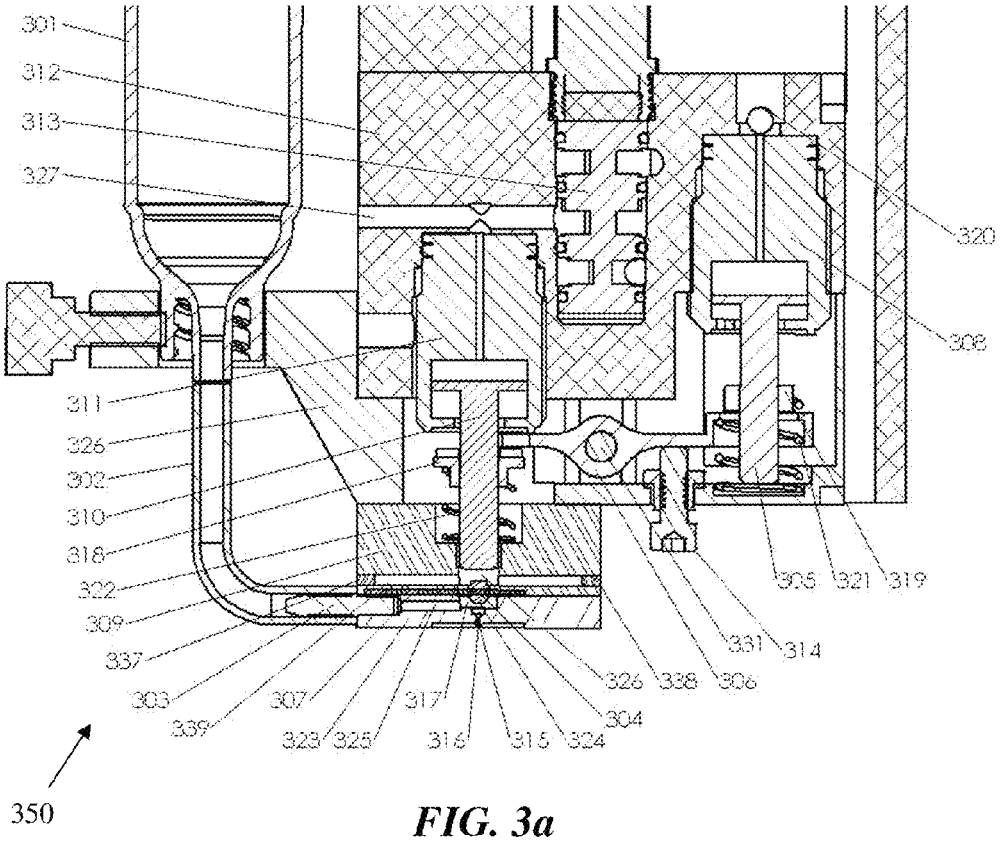
FIG. 3*a* is a side view in cross section of an embodiment of a viscous jetting apparatus utilizing a flexible diaphragm with a contoured diaphragm insert attached so it protrudes through the diaphragm, an adjustable impact element, sensor elements, and an automatic positive shut-off actuator.

Referring to FIG. 3*a*, there is illustrated a high-viscosity jetting apparatus 350 which ejects a drop of high-viscosity fluid through the deflection of a flexible diaphragm 307. Portions of the operation are described in U.S. Patent Application 61/293,837, the complete contents of which are incorporated herein by reference. Air pressure supplied to the fluid from reservoir 301 moves fluid through feed tube 302 into nozzle plate 323 by way of hose barb 303. The fluid enters into jetting chamber 317 by way of inlet conduit 325 which is formed in nozzle plate 323, as by drilling a tubular hole inside the plate 323. The inlet conduit 325 opens into a sidewall of jetting chamber 317 to place the jetting chamber 317 in fluid communication with reservoir 301. Under pressure, the fluid from reservoir 301 proceeds to fill jetting chamber 317 and flows past diaphragm 307 and diaphragm insert 304 into outlet conduit 316 toward orifice 315. Advantageously, the jetting chamber 317 is cylindrical in shape with a bottom that is generally flat and perpendicular to the longitudinal axis of the chamber 317. A corner radius between the jetting chamber walls and the bottom of the jetting chamber can aid in smooth flow of fluid and ease of cleaning.

A pneumatic solenoid valve 313 mounted in manifold 312 diverts air into pneumatic cylinder 311 by way of air conduit 327 which moves impact element 310 toward the diaphragm 307. The level of air pressure diverted into pneumatic cylinder 311 determines the speed of the impact element 310 for a fixed travel distance (stroke) of impact element 310. The air pressure into cylinder 311 can be adjusted to provide a preferred velocity value of impact element 310 to produce high-quality drops. Alternatively, other suitable impact devices could be used. In addition to the pneumatic cylinder 311 and its essential components, an electric solenoid is also considered a suitable device for moving impact element 310, as is a moving electric coil, a linear electric motor, an electric motor with a lead screw or cam, or other programmable motion devices, all of which provide means for moving impact element 310 to eject drops of viscous fluid from jetting chamber 317. A calibration method can be employed consisting of adjusting the air pressure diverted to cylinder 311, ejecting a drop or drops of fluid, inspecting the quality of the jetted drop, and repeating the process until high quality drops are achieve, and setting the air pressure to the preferred value to ensure reliable high-quality jetting.

As the impact element 310 starts to deflect diaphragm 307, fluid in the jetting chamber 317 is forced through the orifice 315. When the diaphragm 307 reaches its furthest deflection, it abuts or mates with the outlet conduit 316 thus stopping the flow of fluid into the conduit and through the orifice 315 and ejects a drop of fluid. Advantageously, the diaphragm inert 304 on diaphragm 307 mates with the outlet conduit 316, with the impact element 310 maintaining contact with the diaphragm 307 or insert 304 until fluid flow into the outlet conduit 316 is stopped. Advantageously, the impact element 310 forces the diaphragm, and preferably forces the insert 304, against the outlet conduit 316 with sufficient impact force to provide sufficient momentum to the fluid in the outlet conduit 316 to eject a high-quality discrete drop of viscous fluid from outlet orifice 315.

Air is then exhausted from the cylinder 311 by way of air solenoid valve 313 which allows impact element 310 to retract by way of the restoring force of return spring 322 which resiliently urges the impact element 310 to its starting position. The spring 322 is illustrated as a coil spring encircling the impact element 310 and having one end abutting a flange, boss or other projection on the impact element and an opposing end abutting an end of a recess in the support structure 309 so as to resiliently urge the impact element 310 to a retracted, at rest position. In the illustrated embodiment the impact element 310 passes through the center of annular spring cap 318 with one end of the spring abutting the cap 318. Alternatively, the impact element 310 could be retracted by other means than a retract spring such as by air pressure. The diaphragm 307 is allowed to relax and move away from the outlet conduit to its preferred, but optional flat relaxed position. When the outlet conduit 316 is unblocked, fluid may flow from jetting chamber 317 into the outlet conduit 316 and toward the orifice 315. When the proper amount of fluid flows into the jetting chamber, the impact element 310 is rapidly extended against diaphragm 307 and ejects the next drop of fluid.

Figure 3B:
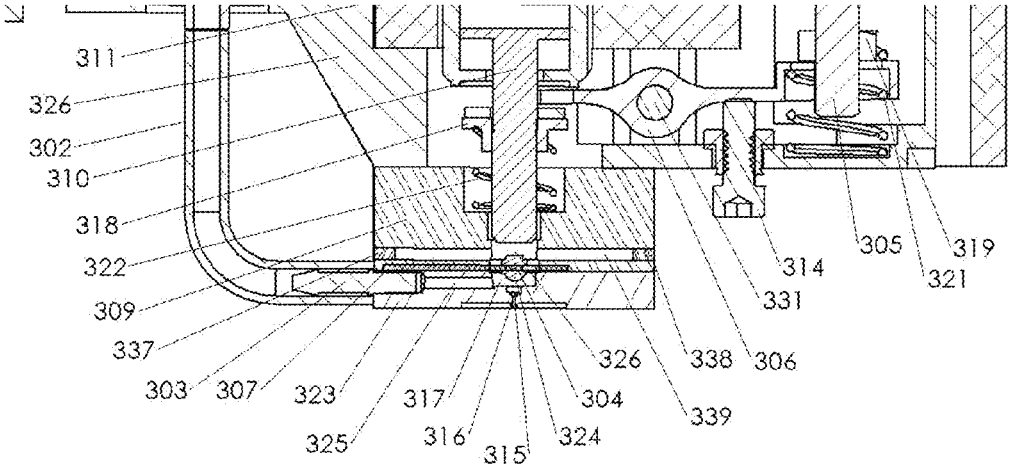
FIG. 3*b* is an enlarged view of a portion of FIG. 3*a* showing the impact element adjusted to allow for maximum momentum transfer.

In order to jet high-quality drops, a specific amount of momentum must be transferred to the viscous fluid to generate an appropriate drop velocity. The amount of momentum can be different for different fluids even when the orifice 315 is unchanged. Shown in FIG. 3*b* is a jetting apparatus with a rotationally mounted lever 306 rotated clockwise to its furthest upward position. The lever 306 has first and second opposing ends, with the first end affecting the maximum upward vertical movement of impact element 310 when in contact with the top of the spring cap 318. The lever 306 is designed so it does not restrict the motion of impact element 310 vertically toward the diaphragm. The second end of lever 306 abuts a stop, preferably an adjustable stop such as adjustment screw 314, which limits rotation of lever 306 and sets the upper vertical movement limit of impact element 310. Thus, the lever 306 does not restrain movement of the impact element 310 toward diaphragm 307, but limits the return movement of the impact element 310. The lever 306 also determines the stroke or length of travel before impact element 310 hits the diaphragm (including hitting any insert in the diaphragm or extending through the diaphragm).

Figure 3C:
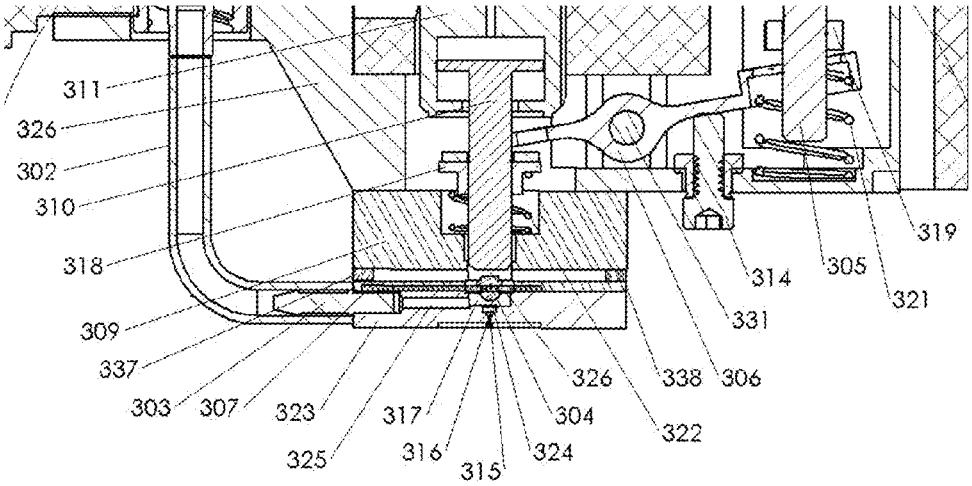
FIG. 3*c* is an enlarged side view in cross section showing the adjusting lever rotated and pushing the initial starting location of the impact element toward the diaphragm thereby reducing the impact gap and resulting in a low value of momentum transfer.

Impact element 310 is forced against lever 306 by return spring 322 which creates an impact gap 326 between diaphragm insert 304 and impact element 310. By changing the distance represented by the impact gap 326, the distance the impact element 310 travels before it impacts the diaphragm 307 (and its insert 304) can be adjusted and thus, the momentum transfer can be adjusted. An impact gap of 1-3 mm for a high impact condition is believed suitable. Alternatively, an impact gap of 0.1-0.5 mm for a low impact condition is believed suitable. The impact element 310 may be adjusted to a maximum height above the diaphragm by way of lever 306 and adjusting screw 314. Referring to FIGS. 3*b* and 3*c*, lever 306 rotates around axel 331, with the first and second ends located on opposing sides of the axel 331 with the second end of lever 306 extending beyond the adjustable stop 314 to connect with an impact element positioning mechanism that may rotate the lever 306 to position the impact element 310 and thus adjust the impact gap 326. The second end of lever 306 may be resiliently urged or spring loaded against the positioning screw 314.

In the preferred embodiment, an air cylinder moves the second end of lever 306 as described later in order to prevent leakage out of orifice 315, but the result is to hold the lever 306 against the positioning screw 314.

Specifically, air is supplied to cylinder 308 (FIG. 3*a*) which forces piston 305 with nut 319 attached thereto to extend and deflect lever 306 until it rests on adjusting screw 314. The piston 305 moves freely through a hole in the second end of lever 306 allowing lever 306 to rotate without binding. The nut 319 on one side of the second end of lever 306, with a compression spring 321 on the other side of the lever resiliently urges the lever against the nut 319. The end of lever 306 is resiliently held between the spring 321 and nut 319 and moves with the piston 305. At the first end of the lever 306, spring cap 318 is attached to impact element 310 and captures retract spring 322 between supporting structure 309 and cap 318. The first end of lever 306 is positioned between spring cap 309 and the outside wall of cylinder 311. The impact element 310 is allowed to move past lever 306 as it extends toward the diaphragm 307. However, as the impact element 310 retracts upward from its extended position, it will be stopped by the second end of lever 306 which abuts the spring cap 318 to set the height of impact gap 326. The height of impact gap 326 can be adjusted by way of the adjusting screw 314 to provide the preferred value to produce high-quality drops. Rotation of screw 314 causes the screw to move axially and move the second end of lever 306 causing the lever to rotate about axel 331 to increase or decrease the impact gap 326. A calibration method can be employed consisting of adjusting the impact gap 326 with adjusting screw 314, ejecting a drop or drops of fluid, inspecting the quality of the jetted drop, and repeating the process until high quality drops are achieve, and setting the impact gap to the preferred distance to ensure reliable high-quality jetting.

Shown is FIG. 3*c* is an impact element 310 adjusted to a small impact gap 326 which will produce a lower level of momentum transfer. By turning adjustment screw 314 so the first end of adjusting lever 306 rotates further downward and reduces the impact gap 326, the upward retract distance of impact element 310 is restricted by the position of lever 306 hitting spring cap 318. Rotating adjustment screw 314 away from the lever 306 causes the first end of the lever to move away from the diaphragm, resulting in a larger impact gap 326 and usually more momentum transfer. Thus, the impact gap 326 or the stroke of the impact element 310 can be adjusted to vary the impact force on the jetted drop.

Figure 3D:
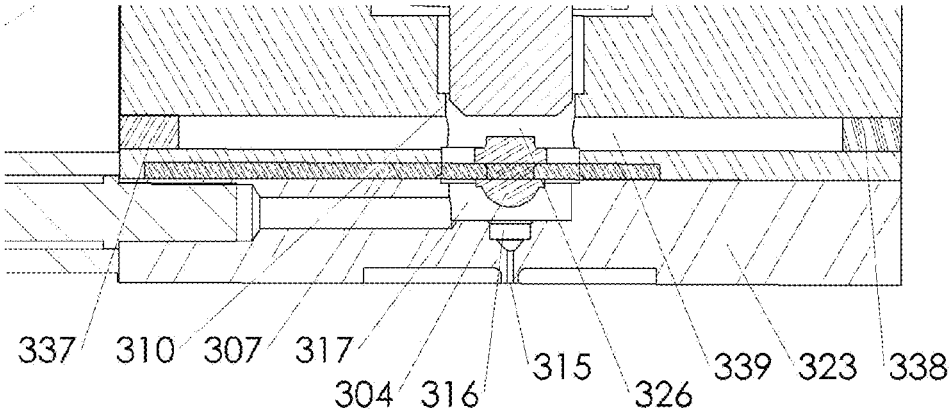
FIG. 3*d* is a further enlarged side view in cross section to better show internal sensing elements viewing an impact gap which comprises the distance between the bottom of the impact element and the top of the diaphragm insert, by way of a viewing channel.

The position of impact element 110 is preferably monitored. As shown in FIG. 3*d* optional sensing elements 337 and 338, preferably comprising optical sensors such as an emitter and detector, are positioned inside support structure 309 to detect the initial position of both the bottom of the impact element 310 and the top of the diaphragm insert 304 by means of viewing channel 339. Sensors 337 and 338 are located on opposing sides of viewing channel 339 and thus have a view of impact gap 326 via viewing channel 339. As impact element 310 moves toward the diaphragm, sensors 337 and 338 measure the position of impact element 310 at different times along its travel. A good choice of sensing elements might be a combination of a light emitting diode or laser on one side of the impact gap 326 and a photo detector on the other side of the impact gap 326. The level of light passing through the gap when impact element 310 is fully retracted could be used to determine the magnitude of the initial impact gap 326. The velocity at the point of striking the diaphragm insert 304 could be determined by the change in magnitude of light passing through the gap as the impact element 310 moves toward the diaphragm 307. Adjusting the height of impact gap 326 combined with inspecting the quality of the drops, a preferred impact gap and preferred impact velocity can be determined. Depending on the information provided by the sensors 337, 338, the location, velocity, acceleration or momentum imparted by the tip of impact element 310 may be determined by appropriate software algorithms in processors that are preferably located in the equipment and in communication with the sensors. Various other sensors could be used to monitor one or more of these properties. One such sensor and droplet ejection system are described in U.S. Pat. No. 5,320,250, the complete contents of which are incorporated herein by reference.

Figure 3E:
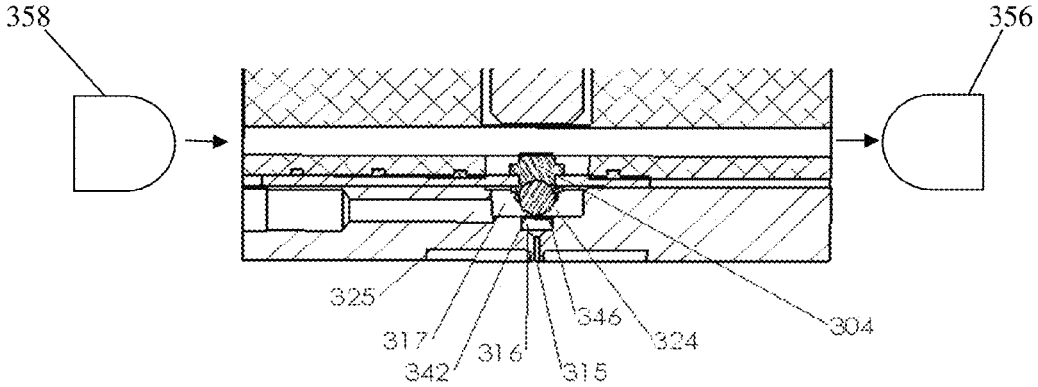
FIG. 3*e* is an enlarged side view in cross section of a further embodiment showing external sensing elements viewing an impact gap which is the distance between the bottom of the impact element and the top of the diaphragm insert, by way of a viewing channel.

An alternative embodiment is shown in FIG. 3*e* where the sensors 356 and 358 are located outside the jetting apparatus, and positioned so that the jetting apparatus can be located between the sensors 356 and 358 in a manner such that the sensors can view the impact gap 326 along the viewing channel 339. External sensors 356 and 358 can be mounted into a calibration station and the jetting apparatus can be moved into position between those external sensors either manually or by a robotic system as described in patent application publication No. US2008/0006653, application Ser. No. 11/685,464, the complete contents of which are incorporated herein by reference. In that application, a robotic arm is movable along the X-Y axes, and can move in the Z axis to grab and/or release the jetting apparatus, allowing the jetting apparatus to be consistently and accurately positioned relative to the external sensors for calibration and testing of the jetting apparatus. The use of external sensors 356, 358 eliminates the space requirements dictated by mounting the sensors within the jetting apparatus and alleviates the need to provide electrical power and control lines for the sensors within the jetting apparatus.

Figure 3F:
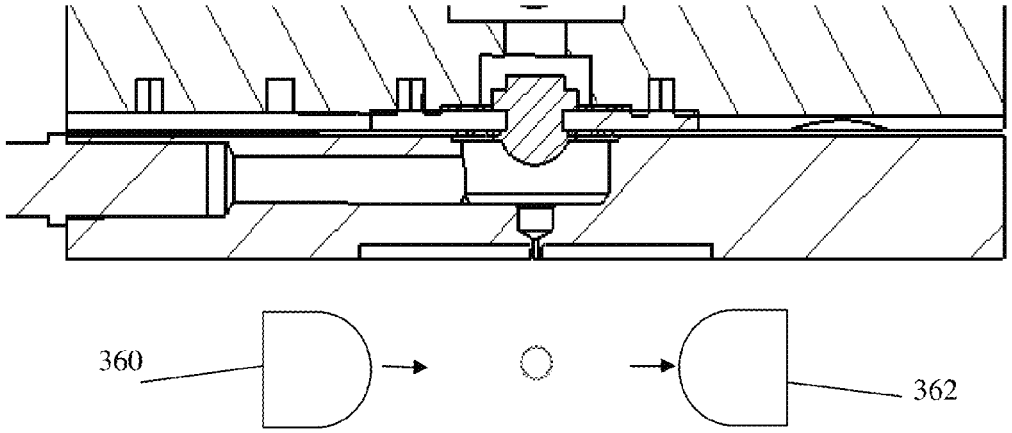
FIG. 3*f* is an enlarged side view in cross section of a further embodiment showing external sensing elements viewing a drop after it is ejected from the orifice to determine the time interval between the command to eject a drop and the time the sensing element detects the drop.

Yet, another alternative embodiment is shown in FIG. 3*f* where the sensors 360 and 362 are located outside the jetting apparatus, and positioned so that the jetting apparatus can be located between the sensors 360 and 362 in a manner such that the sensors can view the ejected drop as it moves away from the orifice. External sensors 360 and 362 can be mounted into a calibration station and the jetting apparatus can be moved into position between those external sensors. Alternatively, the sensors can be integrally mounted below the orifice. As used herein, the term "remote" means a location that is not physically connected to the jetting apparatus but is accessible by the robotic arm.

The preferred velocity of the impact element 310 could drift with time, for example, if there are fluctuations in the air pressure supplied to cylinder 311, the sliding friction of impact element 310 changes, or other changes that affect the speed of impact element 310. The actual velocity of the impacting element 310 could be monitored by sensing elements 337 and 338 and compared to the preferred velocity. Depending on the difference between the preferred and actual velocities, an audio or visual alarm could alert the user that the drop quality could degrade, or the impact gap 326 could be in need of adjustment using screw 314, or that air pressure to cylinder 311 could be in need or adjustment, or other actions may be needed to maintain high-quality jetting. For an example of other actions taken, the impact gap 326 could be adjusted automatically by replacing adjusting screw 314 with a programmable motion element such as an electric motor with a lead screw, a magnetic voice coil, a stepper motor driven cam, a piezoelectric driven mechanism, or other programmable means. One such programmable motion element is described in patent application publication No. US2008/0312025, application Ser. No. 12/045,981, the complete contents of which are incorporated herein by reference. Various other devices configured to movably position the lever 306 or otherwise position the insert 304 may be used, provided the devices can consistently and accurately position the insert 304 at a desired position at a desired accuracy. The desired position accuracy may be a few mm, but is advantageously less, and preferably measured in microns. Additional devices for moving the lever 306 include various ultrasonic or piezoelectric motors, for example those using various piezoelectric drives, with examples including U.S. Pat. Nos. 8,018,125, 7,960,896, 7,633,207, 6,150,750, the complete contents of which are incorporated herein by reference.

A calibration method for the impact element 310 may include adjusting the impact gap 326 with a programmable motion means, measuring the position and speed of the impact element 310 by way of a sensor, such as sensing elements 337 and 338, ejecting a drop and inspecting the quality of the drop, repeating the process until acceptable high-quality drops are produced, noting or recording the preferred impact gap and preferred impact velocity, and setting the preferred impact gap and/or the preferred impact velocity. Advantageously, these steps can be implemented by software located on the jetting equipment.

An alternative calibration method for the impact element 310 may include adjusting the impact gap 326 with a programmable motion means, measuring the velocity of an ejected drop by way of a sensor, such as sensing elements 360 and 362, and inspecting the quality of the drop, repeating the process until acceptable high-quality drops are produced, noting or recording the preferred impact gap and preferred impact velocity, and setting the preferred impact gap and/or preferred impact velocity. Advantageously, these steps can be implemented by software located on the jetting equipment.

Additionally, automatic vision systems capable of capturing and analyzing the quality of the drop are known in the industry and could be used. One such vision system is described in patent application publication No. US2008/0006653, the complete contents of which are incorporated herein by reference. If this type of vision system is used, a fully automatic calibration method can be used that includes adjusting the impact gap 326 with a programmable motion device, ejecting a drop or drops, analyzing the quality of the drop with an automatic vision system, repeating the process until acceptable high-quality drops are produced, noting or recording the preferred impact gap, the preferred impact velocity and the preferred drop velocity, and automatically setting the preferred impact gap 326, preferably by adjusting the lever 306 with the programmable motion element or setting the impact velocity by adjusting the air pressure to the pneumatic cylinder 311. Further, monitoring the actual velocity of the impact element 310 or the ejected drop velocity by sensing elements 337 and 338 can determine if the actual velocity changes when compared to a prior velocity measured the same day or within a known time period, or when compared to the preferred velocity. When the change in velocity is too large or too small, the impact gap 326 or the impact element velocity can be automatically adjusted by the programmable motion elements or the air pressure to the cylinder to maintain high-quality jetting.

Figure 4A:
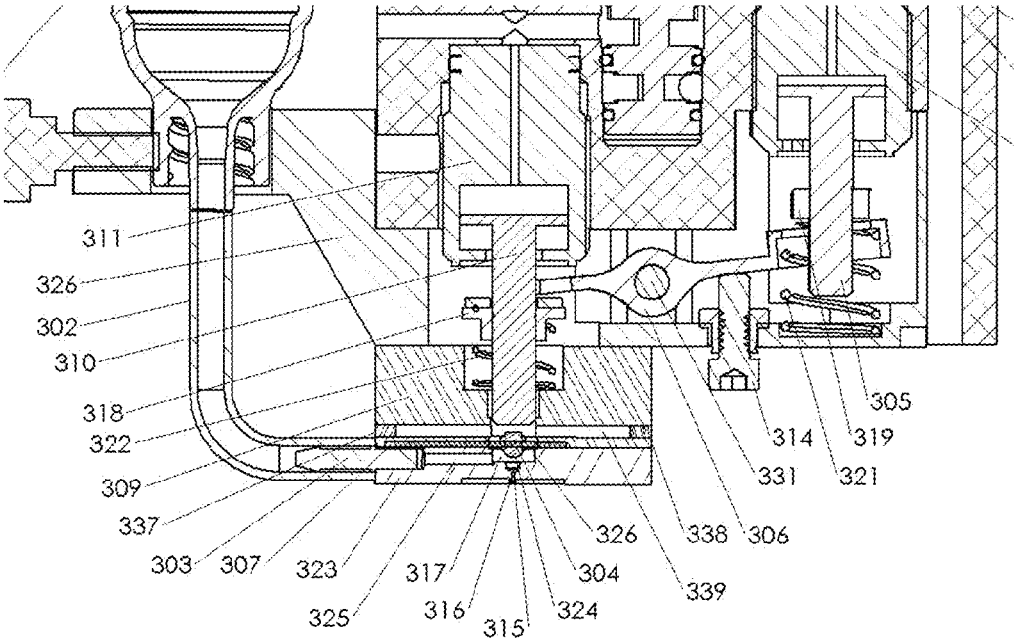
FIG. 4*a* is an enlarged side view in cross section of a viscous jetting apparatus showing the impact element adjusted to allow a for a medium level of energy transfer, and sensing elements that can measure the positions of both the bottom of the impact element, the top of the diaphragm, and the velocity of the impact element when moving.
Figure 4B:
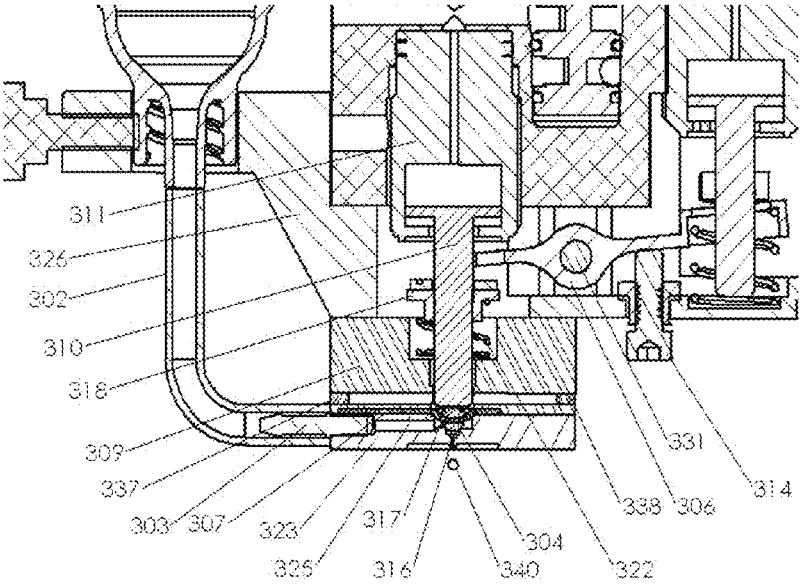
FIG. 4*b* is an enlarged side view in cross section of a viscous jetting apparatus showing the impact element and sensing elements after it has deflected the diaphragm and ejected a drop of fluid.

Shown in FIG. 4*a* is the viscous fluid jetting apparatus in the refill condition after air has been exhausted from cylinder 311. The impact element 310 and spring cap 318 are forced to retract away from the diaphragm 307 by return spring 322 urging the spring cap 318 away from the diaphragm until the spring cap 318 comes to rest against lever 306. The adjusting screw 314 has been set to provide a mid-level impact force using a mid-level impact gap 326. The diaphragm 307 is in its relaxed position, which is normally flat, and held or clamped in that position by any suitable mechanism. Viscous fluid flows into jetting chamber 317 through inlet conduit 325 and flows through the chamber toward the orifice 315. When the desired volume of fluid has flowed into the jetting chamber 317, usually determined by the fluid flow rate multiplied by a specific flow time, the impact element is actuated. As shown in FIG. 4*b*, the impact element 310 is fully extended, has compressed the return spring 322 and no longer rests on the lever 306. The diaphragm 307 has deflected into the jetting chamber 317 and forced fluid out the orifice 315. The impact element 310 has forced the diaphragm or diaphragm insert 304 into the chamber 317 and against the outlet conduit 316. When the diaphragm insert 304 mates with the top of the outlet conduit 316, the drop of viscous fluid 340 will separate from the orifice 315 and fly to the substrate. Drop volumes are typically in the micro liter to nanoliter range. The impact element and return spring can be sized to produce greater than 50 drops/sec and in some cases greater than 300 drops/sec. The lever 306 preferably has not moved even though impact element 310 has extended.

Figure 4C:
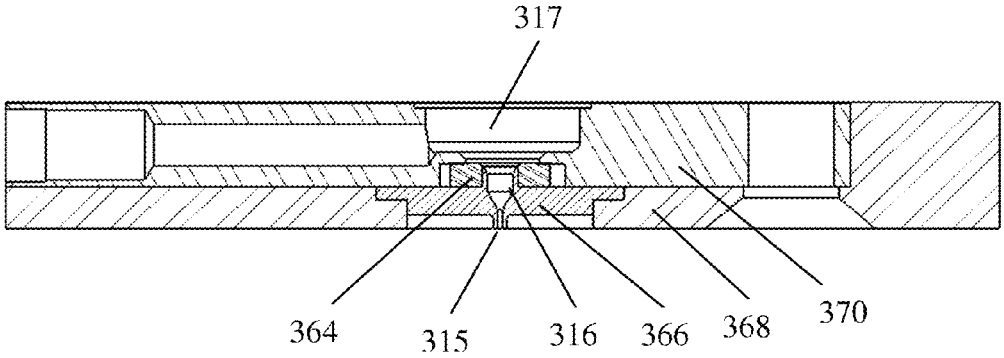
FIG. 4*c* is a side view in cross section of a nozzle plate assembly showing a replaceable seat insert and orifice insert.

Advantageously, the insert 304 seals the outlet conduit 316 and imparts momentum to the fluid in the outlet conduit 316 to help form the drop with the desired high-quality shape and eject the drop from the orifice 315. Referring to FIG. 4*c*, because the insert 304 repeatedly hits the top of the outlet conduit 316 where the conduit enters the jetting chamber 317, the area of contact may be provided with a seat insert 364 of suitable material to increase sealing and life of the contacting parts. Advantageously, an insert of hardened material is placed into this location, forming a hardened opening to the outlet conduit 316. A seat insert 364 with or without a positioning or retaining flange is believed suitable for such an outlet opening. A seat insert of hardened steel, tungsten, tungsten carbide or ceramic is believed suitable. Further, the mating portion of the diaphragm insert 304 and the top of the outlet conduit 316 or the top of seat insert 364 are preferably shaped to allow repeated sealing and long wear. Thus, mating but inclined surfaces, such as conical surfaces on the mating parts, or curved spherical surfaces on the mating parts, is believed preferable. The material in which the orifice 315 is formed may be of the same hardness and material as the insert 304, or it may be of a softer or harder material. Advantageously, an orifice insert 366 is formed of a harder material like tungsten carbide and is fastened in the bottom of jetting chamber 317 with the seat insert also made of tungsten carbide, with both parts advantageously being replaceable. Alternatively, the seat insert 364 and the orifice insert 366 can be combined into an integrally formed single nozzle insert. As shown in FIG. 4*c*, the seat insert 364 and orifice insert 366 can be clamped in place by a support plate 368 and a modified nozzle plate 370 and when assembled form a fluid tight seal but also allowing easy replacement.

As described above, as the air supply to cylinder 311 is exhausted or deliberately vented to stop motion of the impact element 310, the impact element 310 will retract allowing the diaphragm 307 to relax to its non-deflected state. The fluid pressure exerted on flexible diaphragm 307 provides some restoring force, but spring 333 shown in FIG. 7*b*, advantageously provides additional return force. The impact element 310 thus moves between a first position as shown in FIG. 4*a* at a location defining an impact gap 326, and a second position as shown in FIG. 4*b* where the impact element 310 forces the diaphragm insert 304 against the top opening of the outlet conduit 316. When in the first position the diaphragm 307 defines a first jetting chamber volume and when in the second position the diaphragm defines a second jetting chamber volume in that second position, with the second chamber volume which is less than the first chamber volume. The fill and jetting cycles are then repeated, depending on the control signals sent to the pneumatic cylinder 311. A resilient member such as a diaphragm spring 333, can resiliently urge the diaphragm 307 and/or insert 304 into the first position, the position just before impact by the impacting element 310.

Chamber volumes up to a few milliliters in volume are believed suitable for the jetting chamber 317, but chamber volumes of about 50 micro liters, and preferably less, are believed preferable. If the chamber diameter and/or depth are too small the diaphragm is difficult to deflect accurately into the jetting chamber 317, and if too large then the accuracy of the ejected drop of viscous fluid decreases, especially if the fluid inlet to the jetting chamber is not blocked during ejection of the drop. Jetting chambers 317 with volumes of about 25-50 micro liters, measured between the flat chamber top where the undeformed diaphragm is placed (in the first position) and the outlet orifice 315 at the bottom of the chamber, are believed most suitable for the viscous materials discussed herein.

When in the first position shown in FIG. 4*a*, fluid from the inlet channel 325 may flow into the jetting chamber 317 and if impact element 310 remains retracted as would be in the normally-open state or, power-off state, viscous fluid also may flow out the orifice 315. In the power-off condition when there is still fluid in the fluid reservoir 301, fluid may drip out the orifice 315 resulting in a loss of fluid and requiring the expense, labor and inconvenience of clean up. Preferably the second chamber volume is greater than zero as may occur when the diaphragm and its insert do not abut the walls forming the jetting chamber. Preferably, but optionally, the diaphragm 307 and insert 304 do not abut or conform to the sides of the jetting chamber 317 in this second position. Further, it is preferable that the insert 304 does not contact the side walls forming the jetting when the diaphragm 307 is in the first position.

Figure 5B:
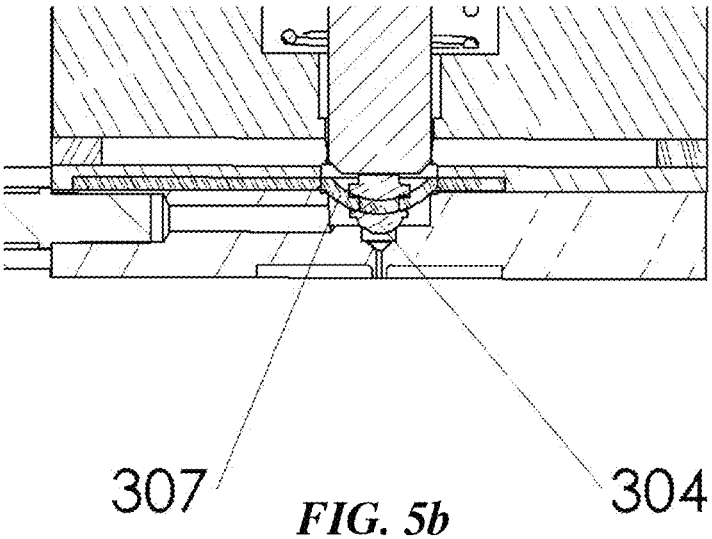
FIG. 5*b* is an enlarged side view, in cross section of FIG. 5*a* showing the fully deflected diaphragm impeding the flow of fluid out the orifice.

Shown in FIG. 5*a*, is a jetting apparatus in the power-off condition with a positive shut-off feature actuated. To prevent the flow of fluid out the orifice 315, a shut off mechanism consisting of pneumatic cylinder 308, piston 305, spring 321, and nut 319 are positioned as shown in the figure in order to actuate the adjusting lever 306. When air is supplied to cylinder 308 by way of air channel 320 the lever's piston 305 will extend and move nut 319 attached to piston 305 to also extend and compress spring 321 and also deflect lever 306 until the lever hits adjusting screw 314 which stops its movement. The adjusting screw 314 is located between rotational axel 306 and the connection with the lever's piston 305. Spring 321 is captured between manifold spacer 326 and lever 306 and resiliently urges the second end of lever 306 to rotate away from adjusting screw 314. In the power-off condition, air is exhausted from cylinder 308 allowing spring 321 to force piston 305 to retract along with nut 319 and resulting in rotating lever 306 away from the adjusting screw 314. As the second end of lever 306 rotates away from adjusting screw 314 the first end of lever 306 forces impact element 310 to deflect the diaphragm 307 until diaphragm insert 304 mates with the outlet conduit 316 as shown in FIG. 5*b* and fluid flow out the orifice 315 is impeded. Thus, spring 321 resiliently urges the lever 306 to move impact element 310 to shut off flow through the outlet conduit 316 and outlet orifice 315. The air actuated piston 305 stops that spring-biased shut-off by holding the lever against the positioning screw 314 when power is on and air is directed into cylinder 308. When power to the jetting apparatus 300 is shut off, the air cylinder 308 is also shut off, allowing the spring 321 to shut-off fluid flow through the outlet conduit. The fluid is sufficiently viscous so capillary forces within blocked conduit 316 will prevent the small amount of fluid in the conduit from dripping out.

Note that if the positioning of the piston 305 is sufficiently accurately controlled, then the adjustment screw 314 may be omitted and the piston 305 may be used to adjust the impact gap 326. A voice coil, piezoelectric actuated mechanism, lead screw driven by a stepper motor, and various other linear motion devices may be used to accurately position the piston 305. Some of these linear positioning mechanisms are discussed above regarding adjustment of the impacting element 310. Preferably though, because the jetted volumes are so small, the increased accuracy provided by adjustment screw 314 is preferred.

In a viscous jetting apparatus which uses a compliant diaphragm to jet the fluid from a chamber, the volume of the ejected drop can be dependent upon the momentum transfer, so changing the momentum can be used to change the volume of the drop. Additionally, the volume of the ejected drop is dependent upon the volume of fluid that enters the jetting chamber during refill. Referring to FIG. 6, the flow gap 324, the distance between the tip of diaphragm insert 304 and the top of the outlet conduit 316 has an effect on the flow rate of fluid into the outlet conduit. Decreasing the flow gap 324 will restrict the flow rate into output conduit 316 and increasing the flow gap 324 will increase the flow rate. A flow gap between about 0.1-1.0 mm is considered suitable for many viscous fluids. The faster the outlet conduit 316 is filled, the faster drops can be jetted from the orifice 315. As shown in FIG. 6, the diaphragm 307 has been deflected into the jetting chamber 317 closing the flow gap 324 simulating a diaphragm which has been exposed to a chemically aggressive fluid and swollen. The diaphragm material might be an inexpensive rubber like EDPM (ethylene propylene diene monomer), or a fluorelastomer dipolymer, such as the trademarked Viton® product sold by DuPont Performance Elastomers, LLC. An aggressive fluid for EPDM might be a fluid containing toluene. An aggressive fluid for Viton® might be a fluid containing acetone. When the diaphragm material is exposed to an aggressive fluid, the diaphragm will soften, swell, and possibly deflect into the jetting chamber 317 resulting in a reduced flow gap 324. There are very inert materials like a perfluoroelastomer, such as the trademarked Kalrez® from DuPont, which are very resistant to swelling. However, the cost of Kalrez® elastomer can be as much as 10 times the cost of EDPM or Viton® making it undesirable for most applications.

Shown in FIGS. 7*a*, 7*b*, 7*c*, and 7*d*, is a diaphragm 307 with a molded in insert 304 with a hardened tip 342 and diaphragm springs 333 and 334 attached. Since the diaphragm spring 333 is in contact with the fluid, it should be made of a suitably nonreactive material like stainless steel or nickel plated steel. Diaphragm spring 334 is not in contact with the fluid so it can be made of any suitable material like spring steel or stainless steel. An outside diameter of the diaphragm spring of 4-8 mm is believed suitable and an inside diameter of 2-4 mm is believed suitable and a thickness of 0.1-0.5 mm is believed suitable.

Figure 8A:
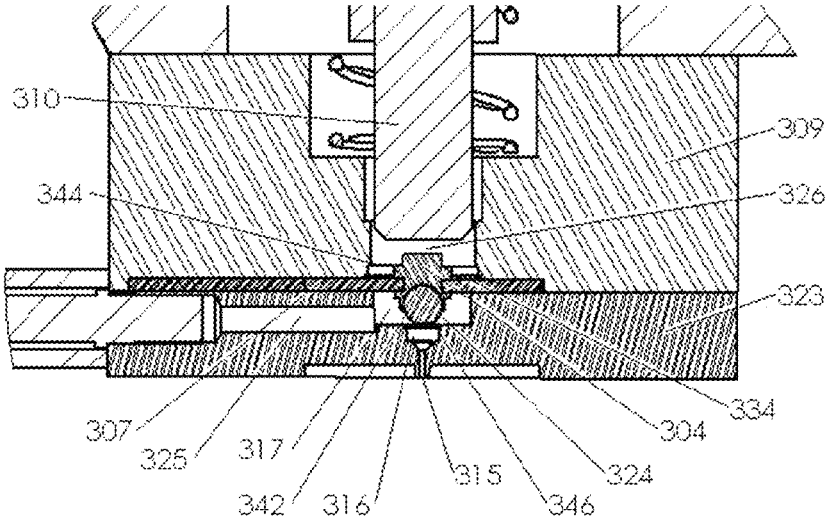
FIG. 8*a* is a side view, in cross section of a jetting apparatus with a swollen fully relaxed compliant diaphragm with a top side diaphragm spring attached to a dual-material diaphragm insert and pulling the diaphragm back to the flat condition maintaining the distance between the contoured feature of the diaphragm insert and the top of the outlet conduit.
Figure 8B:
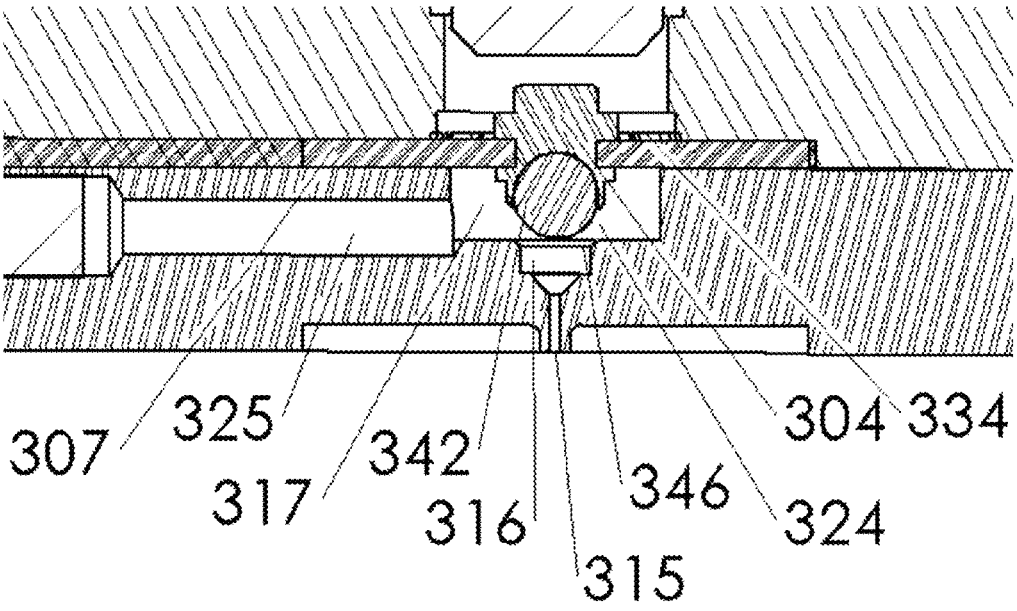
FIG. 8*b* is an enlarged side view, in cross section of a portion of FIG. 7*a* showing the diaphragm insert.

Referring to FIGS. 8*a* and 8*b*, a diaphragm spring 334 has been attached to diaphragm insert 304 on the side not in contact with the fluid being jetted. The diaphragm spring 334 has an annular shape with an outer periphery that is captured between the diaphragm 307 and the supporting structure 309 and with the inner periphery fastened to the diaphragm insert 304. Between the peripheries the diaphragm springs may take various configurations, such as radially extending arms or tangential arms extending between inner and outer peripheral rings. But the diaphragm springs resiliently urge the diaphragm insert 304 upward until it mates with support structure counterbore 344 defining the maximum flow gap 324. Adjusting the position of support structure counterbore 344 can allow different flow gaps.

Figure 9A:
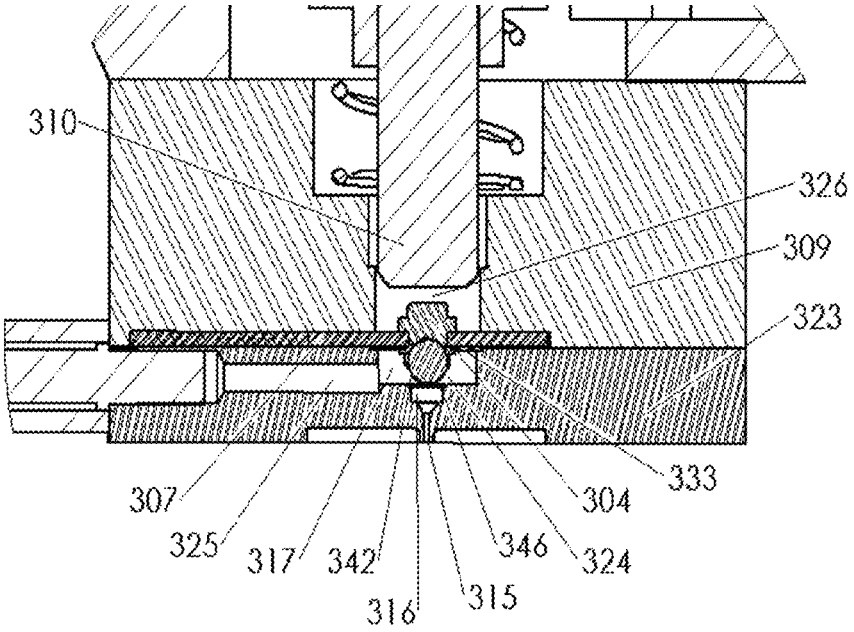
FIG. 9*a* is a side view, in cross section of a jetting apparatus with a swollen and fully relaxed compliant diaphragm with a bottom side diaphragm spring attached to a dual-material diaphragm insert and pushing the diaphragm back to the flat condition and thereby maintaining the distance between the contoured feature of the diaphragm insert and the top of the outlet conduit.
Figure 9B:
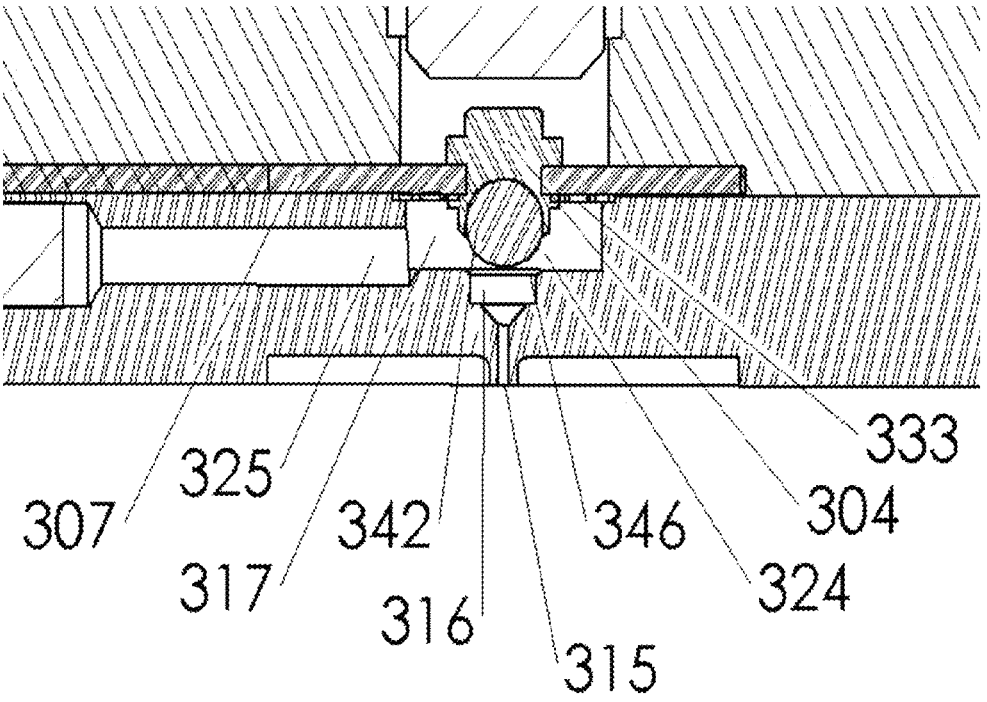
FIG. 9*b* is an enlarged side view, in cross section of FIG. 8*a* showing the diaphragm insert

Referring to FIGS. 9*a* and 8*b*, a diaphragm spring 333 can be attached to the diaphragm insert 304 on the side in contact with the fluid. The diaphragm spring is captured between the nozzle plate 323 and the diaphragm 307 providing an upward force on the diaphragm and urging the diaphragm and insert away from outlet conduit 316 so as to maintain the desired flow gap 324 or to reduce variations in that flow gap from swelling. If the diaphragm 307 is exposed to an aggressive fluid and begins to swell, the diaphragm spring 333 will urge the diaphragm insert 304 upward and away from the outlet conduit 316 thus maintaining the flow gap 324 or at least reducing the effect of swelling on the flow gap.

Each diaphragm spring 333 and 334 can be sized such that the restorative force is sufficient to counteract the force due to material swelling allowing low-cost material to be used with chemically aggressive fluid. Optionally, both diaphragm springs could be used to provide even higher restorative force on the diaphragm. The spring or springs 333, 334 are shown attached directly to the diaphragm insert 304, but alternative constructions could be devised which do not require the spring to be attached to the diaphragm to provide the restorative for to force the diaphragm back to its flat condition. For example, a coiled compression spring could be placed in the jetting chamber 314 between the outlet conduit 316 and the diaphragm 304, or leaf springs or coil extension springs could be connected to the insert 304 on the impact element side of the diaphragm 304. The addition of a diaphragm spring or springs also increases the life of the diaphragm since if swelling occurs without the restorative force of a diaphragm spring, the diaphragm would have to be replaced.

There is thus advantageously provided a diaphragm 307 with a hardened portion extending into the interior of the jetting chamber 317, which hardened portion advantageously extends above a center portion of the chamber and opposite outlet orifice 315. Preferably the hardened portion is of a different and much harder material than the diaphragm 307, and advantageously forms an insert 304 that extends through and onto opposing sides of the diaphragm. Advantageously, the insert extends on both sides of the flexible diaphragm. The insert 304 may extend through an opening formed in the diaphragm 307 with a portion of the insert located on opposing sides of the diaphragm. The insert 304 may be a single, unitary piece of material with the opening in the diaphragm forced over one portion of the insert, or the insert may be made of a male and female part which are fastened together to clamp the diaphragm between the parts.

The insert 304 is preferably made of a material having a hardness at least 5 times as great as a hardness of the diaphragm, and preferably ten or more times as hard as the hardness of the diaphragm 307. There is thus provided a jetting chamber 317 with an outlet 315 in fluid communication with an outlet conduit 316 from which a drop of viscous fluid is expelled, with the diaphragm 307 having a hardened insert 304 located to abut the outlet 315 and expel the fluid. The insert 304 may abut a wall forming the jetting chamber 317 when the diaphragm is deflected, and preferably the insert 304 abuts the wall defining the orifice opening 316. The insert 304 may have a semi-spherical, domed, conical or frusto-conical shape extending into the chamber 317, with the shape preferably being selected to releasably mate with and seal the outlet 315.

Advantageously the insert 304 is integrally molded with the diaphragm 307 and extends beyond the remainder or generally planar surface of the diaphragm. Insert 304 intrudes into the jetting chamber 317 and reduces the volume of the jetting chamber 317. This reduction in volume from intruding portion of the insert 304 reduces the vacant volume of the chamber 317 when the diaphragm returns to its relaxed state. A reduced vacant volume can be preferred in cases when a very minute volume of a viscous drop are desired.

Preferably, the diaphragm 307 has an insert portion 304 comprised of a different material than the diaphragm 307 so the diaphragm has an elastomeric outer portion and a much stiffer or rigid inner insert portion 304. For example, insert portion 304 could be metal or hard plastic, with a domed or semi-spherical portion protruding into jetting chamber 317. The insert 304 may have optional outwardly extending flanges that are clamped, adhered, thermally bonded, molded or otherwise fastened to opposing surfaces of diaphragm 307. The fastening method or mechanism will vary with the materials of diaphragm 307 and insert 304, and may include mechanical fastening mechanisms, adhesives, melting, integral forming of parts, and other fastening means now known or developed in the future. Preferably, the insert 304 is centered over the outlet orifice 315 and outlet conduit 316 and has a longitudinal axis aligned with the orifice 315 and conduit 316, with that longitudinal axis passing through the center of the jetting chamber 317 and insert 304.

When such a diaphragm 307 is deflected the harder insert portion 304 impacts the jetting chamber 317 without the damping effect of the elastomeric material forming the remainder of diaphragm 307. The momentum transfer efficiency from harder insert portion 304 is therefore higher. If insert portion 304 included a shape facing opposite the orifice 315 which also extended through or into the support structure 309, then a mechanical element such as spring 334 could be readily attached to the insert 304 to provide one direction or bidirectional forced deflection of the diaphragm 307. The use of a harder insert 304 in diaphragm 307 is preferred when high impact efficiency is required. Or, the bidirectional forced deflection might be preferred when a sticky or viscous fluid might tend to restrict the relaxation speed of an elastomeric diaphragm 307 so as to cause an unacceptably slow jetting time of viscous drops. An insert 304 that is at least 5-10 times harder than the remainder of diaphragm 307 extending into or over the jetting chamber 317 is preferred.

The above description is given by way of example, and not limitation. Given the above disclosure, one skilled in the art could devise variations that are within the scope and spirit of the invention disclosed herein, including various ways of impacting a diaphragm, measuring and adjusting the impact gap and impact velocity, measuring the drop velocity, determining the quality of the drop, deflecting the diaphragm to shut-off flow when power is off, and a variety of diaphragm spring combinations. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An apparatus for dispensing minute quantities of viscous material from a jetting orifice, comprising: a jetting chamber having sides, an open top, and a bottom having an opening that is in fluid communication with an exit orifice, the chamber being in fluid communication with an external fluid reservoir containing said viscous material during use; a flexible diaphragm covering the open top of the jetting chamber, the diaphragm having a central protrusion extending toward the opening in the bottom of the chamber, the diaphragm being sufficiently flexible to deform between a first, non-jetting position and a second position in which the diaphragm extends into the jetting chamber a distance sufficient so that the central protrusion blocks the opening in the bottom of the chamber during use; a support structure having an opening aligned with the top of the jetting chamber and holding the diaphragm in the first position while allowing the diaphragm to deform to the second position during use; an impact element on the side of the diaphragm opposite the jetting chamber and aligned with the central protrusion; and an adjusting mechanism configured to change the distance the impact element travels before it deforms the diaphragm; a support structure having an opening aligned with the top of the jetting chamber, the opening configured to allow the impact element to impact the diaphragm to deform into the jetting chamber when the impact element is activated; and a sensing device configured to detect the distance between the impact element and the top of the diaphragm; wherein the central protrusion extends on both sides of the diaphragm and the impact element abuts one portion of the central protrusion and forces another portion of the central protrusion against the opening in the chamber bottom, with the protrusion not abutting opposing walls of the jetting chamber.

2. The apparatus of claim 1, wherein the impact element is moving before it contacts and deforms the diaphragm.

3. The apparatus of claim 1, wherein the adjusting mechanism is configured to resiliently urge the central protrusion against the opening in the bottom of the chamber when no power is applied to the apparatus.

4. The apparatus of claim 1, wherein the adjusting mechanism comprises a programmable motion device.

5. The apparatus of claim 1, wherein the sensing device is configured to detect the speed of the impact element as it moves toward the diaphragm during use.

6. The apparatus of claim 1, wherein the protrusion comprises an insert made of a harder material than the diaphragm and is molded to the diaphragm.

7. The apparatus of claim 1, wherein the protrusion has a flange on opposing sides of the diaphragm.

8. An apparatus for rapidly dispensing minute quantities of a highly viscous material from a jetting orifice, comprising: a jetting chamber having sides, an open top, and a bottom having an opening that is in fluid communication with an exit orifice, the chamber being in find communication with an external fluid reservoir containing said material during use: a flexible diaphragm covering the open top of the jetting chamber, the diaphragm having a central protrusion extending toward the opening in the bottom of the chamber on one side of the diaphragm, the diaphragm being sufficiently flexible to deform into the jetting chamber a distance sufficient so that the central protrusion blocks the opening in the bottom of the chamber during use; a support structure having an opening aligned with the to of the jetting chamber and holding the diaphragm in the first position while allowing the diaphragm to deform to the second position during use; an impact element having an impact end spaced apart from the central protrusion on the opposite side of the diaphragm as the opening in the bottom of the chamber and aligned therewith; an adjusting mechanism configured to change the distance the impact element travels before it deforms the diaphragm; a support structure having an opening aligned with the top of the jetting chamber, the opening configured to allow the impact dement to impact the diaphragm to deform into the jetting chamber when the impact element is activated; and a sensing device configured to detect the distance between the impact element and the top of the diaphragm; wherein the central protrusion extends on both sides of the diaphragm and the impact element abuts one portion of the central protrusion and forces another portion of the central protrusion against the opening in the chamber bottom, with the protrusion not abutting opposing walls of the jetting chamber.

9. The apparatus of claim 1, wherein the diaphragm further comprises a seal on a surface of the diaphragm opposite the jetting chamber, the seal having a periphery which encloses the impact element.

10. The apparatus of claim 8, wherein the diaphragm further comprises a seal on one surface of the diaphragm.

11. The apparatus of claim 8, wherein the sensing device includes a light source and a photo detector.

12. The apparatus of claim 8, wherein the insert is of a material harder than the diaphragm and extends through the diaphragm to the side opposite the central protrusion.

13. The apparatus of claim 8, wherein the sensing device is configured to detect the distance between the impact element and the diaphragm or a portion of an insert on the diaphragm.

14. The apparatus of claim 1, wherein the diaphragm further comprises a seal on one surface of the diaphragm.

15. The apparatus of claim 8, wherein the diaphragm further comprises a seal on a surface of the diaphragm opposite the jetting chamber, the seal having a periphery which encloses the impact element.

16. The apparatus of claim 8, wherein the sensing device is configured to detect the speed of the impact element as it moves toward the diaphragm.

* * * * *